US009234413B2

(12) United States Patent
Ayirala et al.

(10) Patent No.: US 9,234,413 B2
(45) **Date of Patent: *Jan. 12, 2016**

(54) WATER INJECTION SYSTEMS AND METHODS

(75) Inventors: Subhash Chandra Bose Ayirala, Houston, TX (US); Robert Wing-Yu Chin, Katy, TX (US); Andreas Nicholas Matzakos, Missouri City, TX (US); Ernesto Uehara-Nagamine, Houston, TX (US)

(73) Assignee: Shell Oil Company, Houston, TX (US)

( * ) Notice: Subject to any disclaimer, the term of this patent is extended or adjusted under 35 U.S.C. 154(b) by 614 days.

This patent is subject to a terminal disclaimer.

(21) Appl. No.: 13/379,745

(22) PCT Filed: Jun. 23, 2010

(86) PCT No.: PCT/US2010/039634

§ 371 (c)(1), (2), (4) Date: Jan. 19, 2012

(87) PCT Pub. No.: WO2010/151574

PCT Pub. Date: Dec. 29, 2010

(65) Prior Publication Data

US 2012/0125611 A1 May 24, 2012

Related U.S. Application Data

(60) Provisional application No. 61/220,364, filed on Jun. 25, 2009.

(51) Int. Cl.

| | |
|---|---|
| ***E21B 43/40*** | (2006.01) |
| ***E21B 43/20*** | (2006.01) |
| ***E21B 21/06*** | (2006.01) |

(52) U.S. Cl.

CPC ..... *E21B 43/20* (2013.01); *E21B 21/068* (2013.01); *E21B 43/40* (2013.01)

(58) Field of Classification Search

CPC ..... B01D 61/027; E21B 43/20; E21B 43/24; E21B 21/00; E21B 43/28; E21B 43/40; E21B 21/068

See application file for complete search history.

(56) References Cited

U.S. PATENT DOCUMENTS

| | | | |
|---|---|---|---|
| 332,492 | A | 12/1885 | Watson |
| 2,308,564 | A | 1/1943 | McKee |

(Continued)

FOREIGN PATENT DOCUMENTS

| | | |
|---|---|---|
| CN | 1963143 | 5/2007 |
| CN | 101289932 | 10/2008 |

(Continued)

OTHER PUBLICATIONS

Balat, M. et al., "Recent Trends in Global Production and Utilization of Bio-Ethanol Fuels", Applied Energy, 2009, vol. 86, pp. 2273-2282.

(Continued)

*Primary Examiner* — Zakiya W Bates

(57) ABSTRACT

A system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some monovalent ions, and then injects the water into the well.

20 Claims, 6 Drawing Sheets

(56) References Cited

U.S. PATENT DOCUMENTS

| | | | | |
|---|---|---|---|---|
| 3,248,278 | A | 4/1966 | Wilson | |
| 3,549,319 | A | 12/1970 | Wilson et al. | |
| 3,821,355 | A | 6/1974 | Bandyopadhyay et al. | |
| 4,070,232 | A | 1/1978 | Funk | |
| 4,113,842 | A | 9/1978 | McCullough et al. | |
| 4,238,459 | A | 12/1980 | Phillips, Jr. et al. | |
| 4,306,101 | A | 12/1981 | Slaugh et al. | |
| 4,316,008 | A | 2/1982 | Willis et al. | |
| 4,341,629 | A | 7/1982 | Uhlinger | |
| 4,396,761 | A | 8/1983 | Willis et al. | |
| 4,409,032 | A | 10/1983 | Paszner et al. | |
| 4,461,648 | A | 7/1984 | Foody | |
| 4,612,286 | A | 9/1986 | Sherman et al. | |
| 4,669,545 | A | 6/1987 | Slaugh | |
| 4,723,603 | A | 2/1988 | Plummer | 166/268 |
| 4,842,736 | A | 6/1989 | Bray et al. | 210/321.61 |
| 5,238,574 | A | 8/1993 | Kawashima et al. | 210/652 |
| 5,536,325 | A | 7/1996 | Brink | |
| 5,726,046 | A | 3/1998 | Farone et al. | |
| 5,789,210 | A | 8/1998 | Ho et al. | |
| 5,820,687 | A | 10/1998 | Farone et al. | |
| 6,475,768 | B1 | 11/2002 | Otero et al. | |
| 7,741,084 | B2 | 6/2010 | Vitanen et al. | |
| 7,741,119 | B2 | 6/2010 | Vitanen et al. | |
| 7,781,191 | B2 | 8/2010 | Dunson, Jr. et al. | |
| 2003/0162271 | A1 | 8/2003 | Zhang et al. | |
| 2003/0230535 | A1 | 12/2003 | Affeld et al. | 210/652 |
| 2008/0190013 | A1 | 8/2008 | Argyropoulos | |
| 2008/0216391 | A1 | 9/2008 | Cortright et al. | |
| 2009/0061490 | A1 | 3/2009 | Edwards et al. | |
| 2010/0184151 | A1 | 7/2010 | Tolan et al. | |
| 2010/0243246 | A1 | 9/2010 | Ayirala et al. | 166/266 |
| 2011/0154721 | A1 | 6/2011 | Chheda et al. | |
| 2011/0282115 | A1 | 11/2011 | Chheda et al. | |
| 2012/0122152 | A1 | 5/2012 | Blackbourn et al. | |

FOREIGN PATENT DOCUMENTS

| | | | |
|---|---|---|---|
| EP | 863901 | 10/2003 | |
| EP | 1727890 | 5/2008 | |
| EP | 1633954 | 12/2008 | |
| GB | 1520877 | 8/1978 | |
| WO | 9513362 | 5/1995 | |
| WO | 9742307 | 11/1997 | |
| WO | 0202826 | 1/2002 | |
| WO | WO2004106697 | 12/2004 | E21B 43/20 |
| WO | 2006007691 | 1/2006 | |
| WO | WO2006008439 | 1/2006 | E21B 43/16 |
| WO | 2006096130 | 9/2006 | |
| WO | 2007009463 | 1/2007 | |
| WO | 2007028811 | 3/2007 | |
| WO | 2007112254 | 10/2007 | |
| WO | WO2007112254 | 10/2007 | E21B 43/20 |
| WO | 2007136762 | 11/2007 | |
| WO | WO2007144591 | 12/2007 | E21B 43/20 |
| WO | 2008119082 | 10/2008 | |
| WO | 2009109631 | 9/2009 | |
| WO | 2010026572 | 3/2010 | |
| WO | 2010029568 | 3/2010 | |
| WO | 2010046051 | 4/2010 | |
| WO | 2010071805 | 6/2010 | |
| WO | 2012061596 | 5/2012 | |
| WO | 2013082141 | 6/2013 | |

OTHER PUBLICATIONS

Brown, R., "Fast Pyrolysis and Bio-Oil Upgrading, Biomass-to-Diesel Workshop", Pacific Northwest National Laboratory, Sep. 2006, pp. 1-46.

Galbe, M. et al., "A Review of the Production of Ethanol from Softwood"; Appl Microbiol Biotechnol, 2002, vol. 59, pp. 618-628.

Holtzapple, M.T. et al., "The Ammonia Freeze Explosion (AFEX) Process—A Practical Lignocellulose Pretreatment", Applied Biochemistry and Biotechnology, 1991, vols. 28/29, pp. 59-74.

Humbird, D., et al., "Economic Impact of Total Solids Loading on Enzymatic Hydrolysis of Dilute Acid Pretreated Corn Stover", Biotechnol. Prog., 2010, vol. 26, No. 5, pp. 1245-1251.

Kumar, P. et al., "Methods for Pretreatment of Lignocellulosic Biomass for Efficient Hydroloysis and Biofuel Production", Ind. Eng. Chem. Res., Apr. 2009, vol. 48; No. 8, pp. 3713-3729.

Lavarak, B.P. et al., "The acid hydrolysis of Sugarcane Bagasse Hemicelluloses to Product Xylose, Arabinose, Glucose and Other Product", Biomass and Bioenergy, 2002, vol. 23, pp. 367-380.

Moller, Dr. Ralf, "Cell Wall Saccharification", Outputs from the EPOBIO Project, University of New York, Dept. of Biology, 2006, pp. 1-69.

Mosier, N. et al., "Features of Promising Technologies for Pretreatment of Lignocellulosic Biomass", Bioresource Technology, 2005, vol. 96, pp. 673-686.

Ong, L. K., "Conversion of Lignocellulosic Biomass to Fuel Ethanol—a Brief Review", The Planter, Aug. 2004, pp. 517-524.

PCT International Search Report dated Mar. 26, 2012 for Application No. PCT/US2011/059140.

PCT International Search Report dated Jul. 19, 2013 for counterpart Application No. PCT/US2013/039843.

Figure 1 - Prior Art

WATER INJECTION SYSTEMS AND METHODS

PRIORITY CLAIM

The present application claims priority from PCT/US2010/039634, filed 23 Jun. 2010, which claims priority from U.S. provisional application No. 61/220,364, filed 25 Jun. 2009.

FIELD OF INVENTION

The present disclosure relates to systems and methods for injecting water into a hydrocarbon bearing formation.

BACKGROUND

Oil accumulated within a subterranean oil-bearing formation is recovered or produced therefrom through wells, called production wells, drilled into the subterranean formation. A large amount of such oil may be left in the subterranean formations if produced only by primary depletion, i.e., where only formation energy is used to recover the oil. Where the initial formation energy is inadequate or has become depleted, supplemental operations, often referred to as secondary, tertiary, enhanced or post-primary recovery operations, may be employed. In some of these operations, a fluid is injected into the formation by pumping it through one or more injection wells drilled into the formation, oil is displaced within and is moved through the formation, and is produced from one or more production wells drilled into the formation. In a particular recovery operation of this sort, seawater, field water or field brine may be employed as the injection fluid and the operation is referred to as a waterflood. The injection water may be referred to as flooding liquid or flooding water as distinguished from the in situ formation, or connate water. Fluids injected later can be referred to as driving fluids. Although water is the most common, injection and drive fluids can include gaseous fluids such as air, steam, carbon dioxide, and the like.

Water may be injected by itself, or as a component of miscible or immiscible displacement fluids. Sea water (for offshore wells) and brine produced from the same or nearby formations and water from rivers and lakes (for onshore wells) may be most commonly used as the water source.

GB Patent Specification Number 1,520,877, filed Oct. 14, 1974, discloses that secondary recovery of oil from a permeable stratum is effected using as a drive fluid water whose ionic compositions and/or ionic concentration has been adjusted in a reverse osmosis desalination plant so that the water is compatible with the stratum and the connate water associated therewith. Seawater is treated by the reverse osmosis desalination plant to remove a major proportion of the divalent or higher valency ions and to have its ionic concentration adjusted either by mixing the filtrate and concentrate in predetermined proportions or by recycling the concentrate from each cycle at a higher feed pressure. Particles having a diameter of at least 1 micron may initially be removed by ultrafiltration apparatus.

U.S. Patent Application 2003/0230535 discloses a method and well for desalinating saline aquifer water, wherein saline aquifer water flows from a subsurface aquifer layer directly into a downhole aquifer inflow region of a desalinated water production well in which a downhole assembly of one or more desalination and/or purification membranes is arranged, which separate the saline aquifer water into a primary desalinated water stream which is produced through the well to surface and a secondary concentrated brine reject stream, which can be disposed into a subsurface brine disposal zone.

Co-pending published PCT patent application WO 2007/112254, having attorney docket number TH2869 discloses a system comprising a well drilled into an underground formation; a production facility at a topside of the well; a water production facility connected to the production facility; wherein the water production facility produces water by removing some ions and adding an agent which increases the viscosity of the water and/or increases a hydrocarbon recovery from the formation, and injects the water into the well.

Co-pending U.S. patent application 2010/0024326, having attorney docket number TH3740 discloses a system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some multivalent ions, and then injects the water into the well.

Referring to FIG. 1, there is illustrated prior art system 100. System 100 includes body of water 102, underground formation 104, underground formation 106, and underground formation 108. Production facility 110 may be provided at the surface of body of water 102. Well 112 traverses body of water 102 and formation 104, and has openings in formation 106. A portion of formation 106 may be fractured and/or perforated as shown at 114. Oil and gas may be produced from formation 106 through well 112, to production facility 110. Gas and liquid may be separated from each other, gas may be stored in gas storage 116 and liquid may be stored in liquid storage 118.

There is a need in the art for improved systems and methods for producing oil and/or gas from a subterranean formation. In particular, there is a need in the art for systems and methods for providing an improved water flood.

SUMMARY OF THE INVENTION

One aspect of the invention provides a system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some monovalent ions, and then injects the water into the well.

One aspect of the invention provides a method comprising removing some multivalent ions from water; removing some monovalent ions from water; adding some monovalent ions to the water; and injecting the water into an underground formation. In some embodiments, the processed water is recycled by being produced with oil and/or gas and separated, and then re-injected into the formation.

Another aspect of the invention provides a system comprising a first well drilled into an underground formation; a production facility at a topside of a first well; a water production facility connected to the production facility; a second well drilled into the underground formation; wherein the water production facility produces water by removing some ions, and injects the water into the second well and into the underground formation.

DETAILED DESCRIPTION OF THE INVENTION

Figure 1:
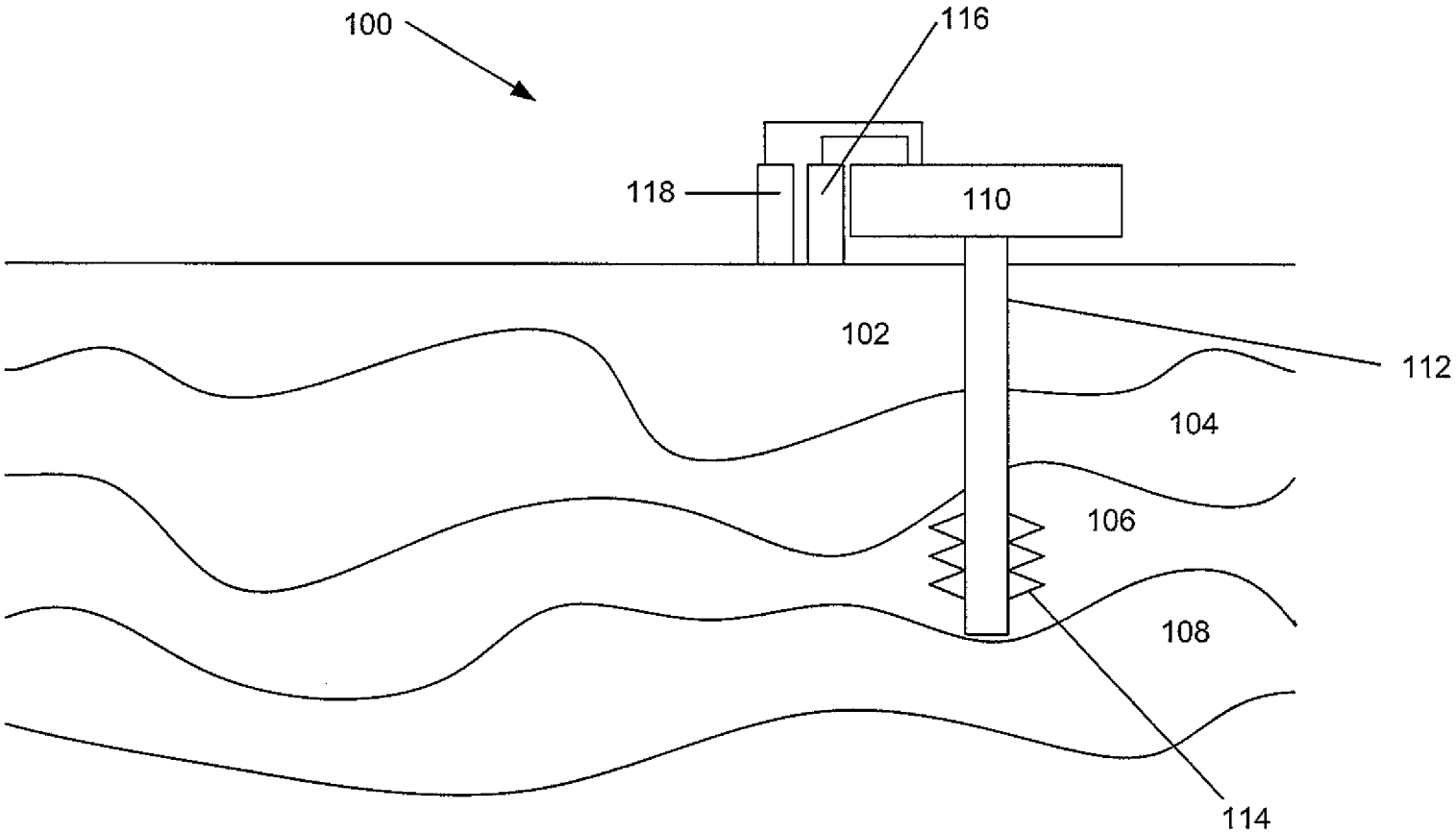
FIG. 1 illustrates a prior art oil and gas production system.
Figure 2:
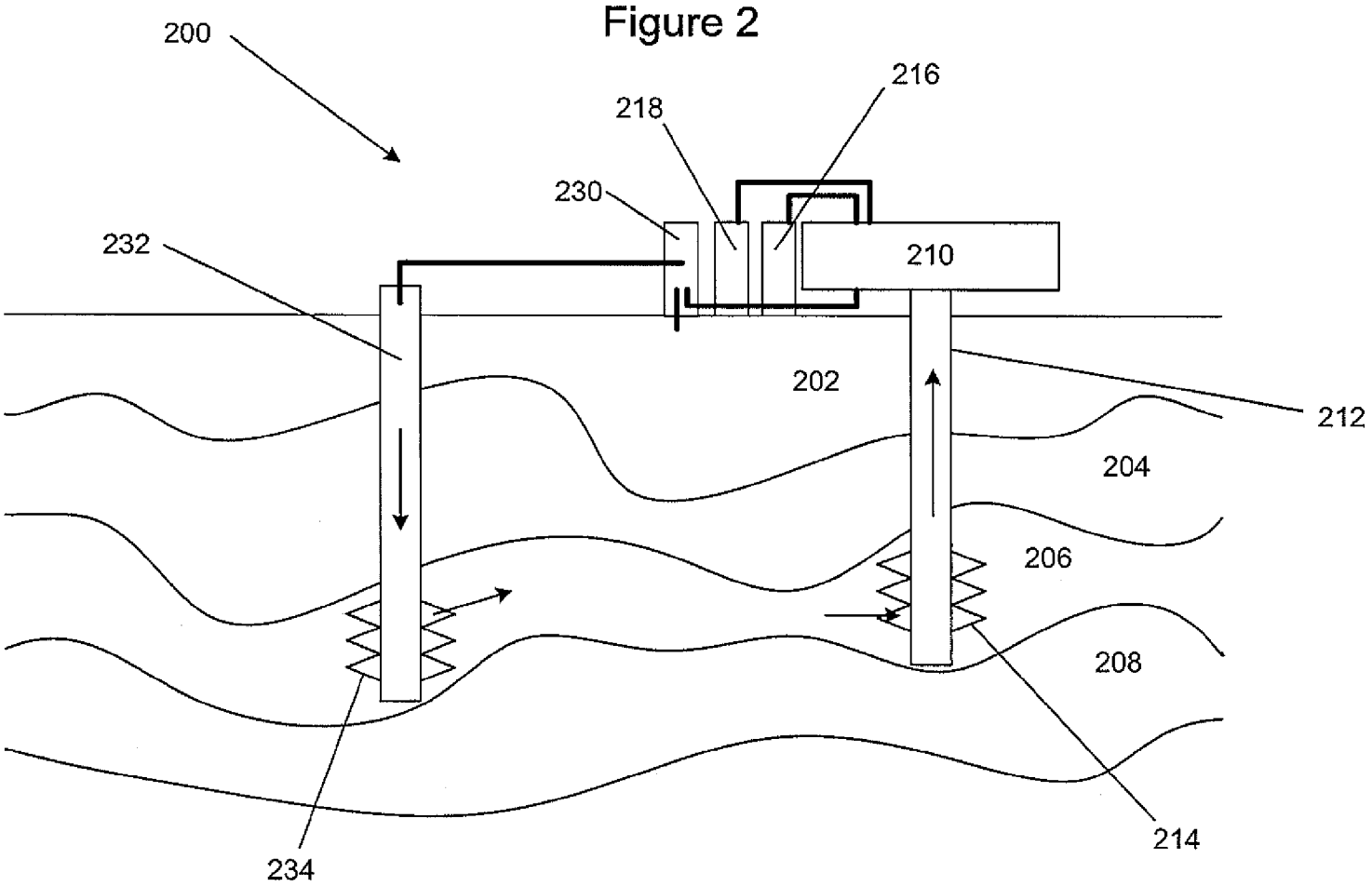
FIG. 2 illustrates an oil and gas production system.

FIG. 2:

Referring now to FIG. 2, in one embodiment of the invention, system 200 is illustrated. System 200 includes body of water 202, formation 204, formation 206, and formation 208. Production facility 210 may be provided at the surface of body of water 202. Well 212 traverses body of water 202 and formation 204, and has openings at formation 206. Portions of formation may be fractured and/or perforated as shown at 214. As oil and gas is produced from formation 206 it enters portions 214, and travels up well 212 to production facility 210. Gas and liquid may be separated, and gas may be sent to gas storage 216, and liquid may be sent to liquid storage 218, and water may be sent to water production 230. Production facility 210 is able to process water, for example from body of water 202 and/or well 212, which may be processed and stored in water production 230. Water from well 212 may be sent to water production 230. Processed water may be pumped down well 232, to fractured portions 234 of formation 206. Water traverses formation 206 to aid in the production of oil and gas, and then the water the oil and gas may be all produced to well 212, to production facility 210. Water may then be recycled, for example by returning water to water production 230, where it may be processed, then re-injected into well 232.

Hydrocarbons, such as oil and/or gas, may be recovered from the earth's subsurface formation 206 through production wellbore 212 that penetrate hydrocarbon-bearing formations or reservoirs. Perforations may be made from the production wellbore 206 to portions of the formation 214 to facilitate flow of the hydrocarbons from the hydrocarbon-bearing formations to the production wellbore. Water may be injected under pressure into injection zones 234 formed in the subsurface formation 206 to stimulate hydrocarbon production through the production wells in a field. Water may be injected by itself or as a component of miscible or immiscible displacement fluids. Sea water (for offshore and/or near onshore wells) and brine produced from the same or nearby formations (for offshore and/or onshore wells) may be used as the water source. Such water may contain amounts (concentration) of precursor ions, such as divalent sulfate ($SO_4^-$), which may form insoluble salts when they come in contact with cations, such as $Ba^{++}$, $Sr^{++}$ and $Ca^{++}$, resident in the formations. The resulting salts ($BaSO_4$, $SrSO_4$ and $CaSO_4$) can be relatively insoluble at subsurface formation temperature and pressure. Such salts may precipitate out of the solution. The precipitation of the insoluble salts may accumulate and consequently plug the subsurface fluid passageways. The plugging effects may be most severe in passageways in the formation near the injection well 232 and at the perforations of the production well 212. Solubility of the insoluble salts may further decrease as the injection water is produced to the surface through the production well 212, due to the reduction of the temperature and pressure as the fluids move to the surface through the production well. Subsurface or formation fluid passageways may include pores in the formation matrix, fractures, voids, cavities, vugs, perforations and fluid passages through the wells, including cased and uncased wells, tubings and other fluid paths in the wells. Precipitates may include insoluble salts, crystals or scale. Plugging may include reduction in the porosity and/or permeability of fluid passageways and the tubulars used in producing the well fluids and processing of those fluids. Injection water may include any fluid containing water that is injected into a subsurface formation to facilitate recovery of hydrocarbons from subsurface formations.

One purpose of injection well 232 is to aid the flow of hydrocarbons from the reservoir to production well 212. One method is to inject water under pressure adjacent to a production zone to cause the hydrocarbons trapped in the formation 206 to move toward the production well 212.

Figure 3:
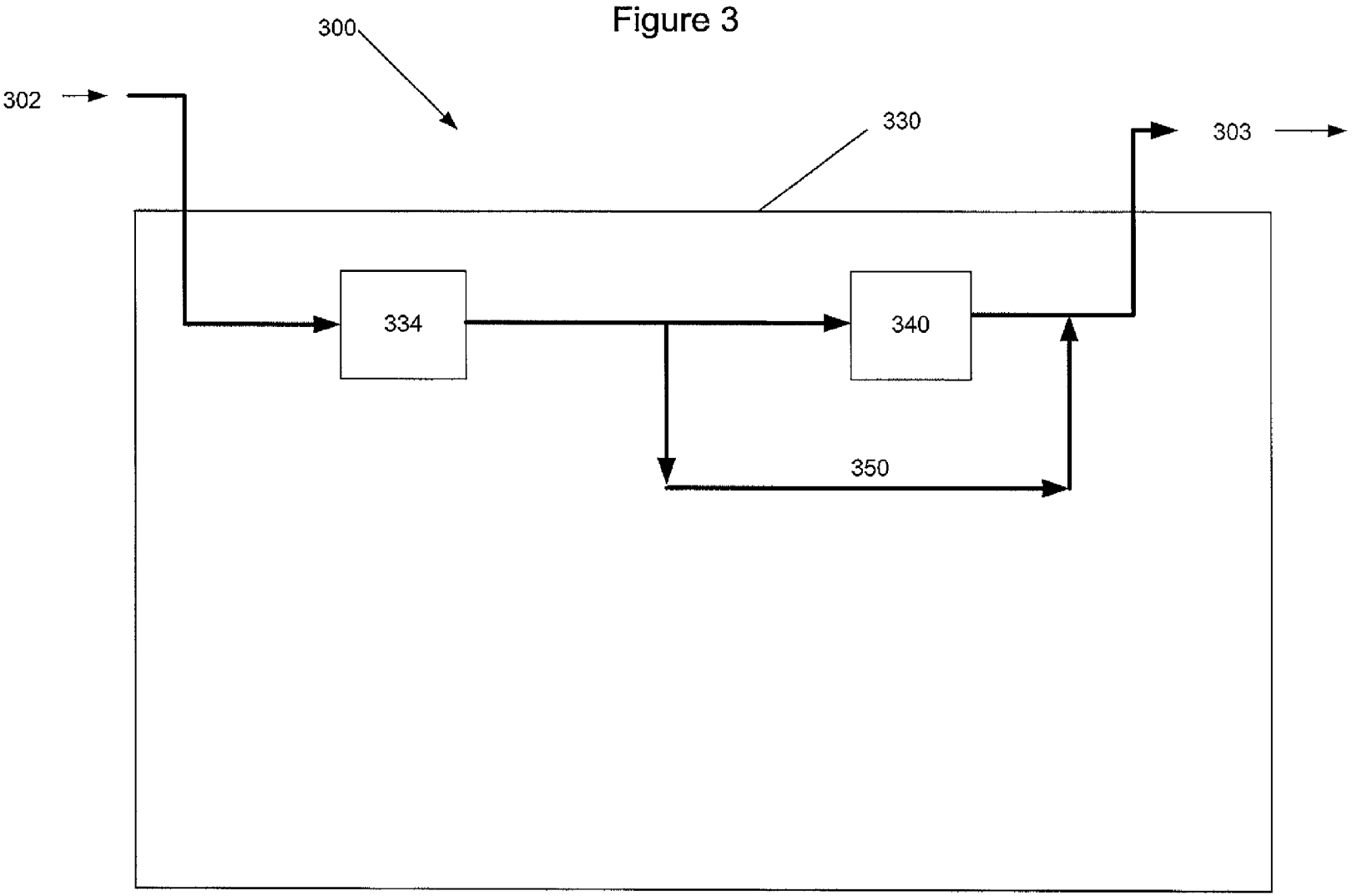
FIG. 3 illustrates a water processing system.

FIG. 3:

Referring now to FIG. 3, in some embodiments of the invention, a system 300 for water production 330 is illustrated. Water production 330 has an input of unprocessed water 302, for example water from a body of water, from a well, seawater, city water supply, or another water supply. At 334 some cations may be removed from water from which multivalent cations have been removed, for example multivalent cations, such as divalent or trivalent cations. At 340, monovalent cations may be removed from raw water 302.

A portion of the water may bypass 340 by conduit 350, for example from about 5% to about 75% by volume, or from about 10% to about 50%, or from about 20% to about 40%. Processed water 303 is then produced from water production 330.

Figure 4:
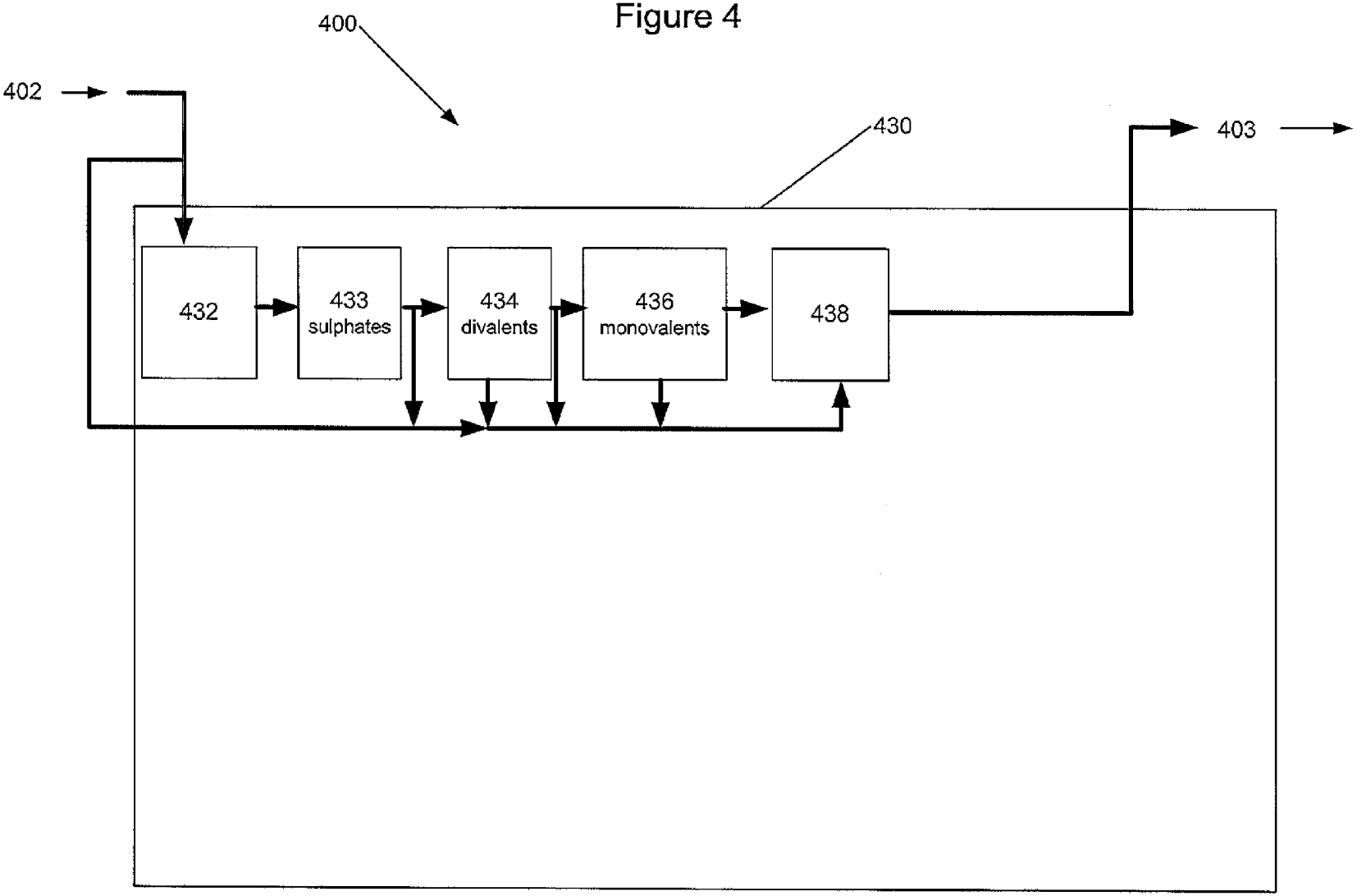
FIG. 4 illustrates a water processing system.

FIG. 4:

Referring now to FIG. 4, in some embodiments of the invention, system 400 for water production 430 is illustrated. Water production 430 has an input of unprocessed water 402, for example water from the body of water from a well, an underground formation, sea water, sewage treatment plant, city water supply, or another water supply. At 432, primary filtration may be accomplished to remove solids from water. At 433 sulphates ($SO_4$) may be removed. At 434, some divalent cations may be removed, for example from about 60 to about 99% of the divalent cations present. Divalent cations which may be removed include magnesium (Mg), calcium (Ca), iron (Fe) and/or strontium (Sr).

In some embodiments, 433 and/or 434 may be performed with nanofiltration membrane systems.

At 436, some monovalent ions may be removed, for example from about 60 to about 99% of the cations present, such as sodium (Na), and/or potassium (K), along with the associated anions, for example chloride, fluoride, and/or bromide.

At 438, some monovalent and/or divalent cations may be added back to water, for instance adding back some sodium, potassium, magnesium, calcium, and/or strontium. Processed water 403 may be produced by water production 430.

The amount of ions to return to the water at 438 may be tailored or customized based on the formation and reservoir conditions. For example, one or more of unprocessed water 402, sulphate permeate 433, divalent reject 434, divalent permeate 434, and/or monovalent reject 436 may be added to back at 438 to have a reduced salinity water, with sufficient monovalent and divalent cations, which avoids clay swelling of the formation. As different clays react differently, each water mixture can be customized to the formation clay. For example, to avoid clay swelling in a smectite clay about 3% of seawater would need to be added in (see FIG. 5), while to avoid clay swelling in a illite clay about 0.5% of seawater would need to be added in (see FIG. 6).

In some embodiments, water production 330 and/or 430 may use a membrane based system, for example reverse osmosis (RO) and/or nanofiltration (NF) technology, such as are used for seawater desalination, filtration, and/or purification.

The driving force for permeation for membrane separation may be the net pressure across the membrane; this is defined as the feed pressure minus the permeate or back pressure, less the difference between the osmotic pressure of the feed and the osmotic pressure of the permeate.

U.S. Pat. No. 4,723,603 employs NF membranes for specific removal of sulfate from seawater. Sulfates may be removed by NF membranes, and the NF permeate, may be rich in sodium chloride but deficient in sulfate. Such sulfate-free water may prevent the formation of barium sulfate, which has low solubility and can cause clogging. U.S. Pat. No. 4,723,603 is herein incorporated by reference in its entirety.

U.S. Pat. No. 4,341,629 discloses desalinating seawater by using two RO modules, which can include the same membrane, e.g. a 90% rejection cellulose triacetate (CTA) RO membrane, or two different membranes, e.g. an 80% rejection CTA membrane and a 98% rejection CTA membrane. U.S. Pat. No. 4,341,629 is herein incorporated by reference in its entirety.

U.S. Pat. No. 5,238,574 discloses the use of a multiplicity of RO membrane modules to process seawater. For example, a first low-pressure RO membrane may be followed by a high pressure RO membrane, or a series of low pressure RO membranes can be used, to either provide permeate of varying water quality or simply to produce a combined permeate where the concentrate stream from one module becomes the feedstream for the next module in series. U.S. Pat. No. 5,238,574 is herein incorporated by reference in its entirety.

In some embodiments, system 400 may include unprocessed water 402, from an aqueous feed source such as seawater from the ocean, or any saline water source having some divalent and monovalent ions, such as produced water from a well. As one example, raw seawater may be taken from the ocean, either from a sea well or from an open intake, and initially subjected to primary filtration 432 using a large particle strainer (not shown), and/or multi-media filters, which might be typically sand and/or anthracite coal, optionally followed by a cartridge filtration.

In some embodiments, processes 433, 434, and/or 436 can include one or a plurality of RO cartridges which may be located downstream of one or a plurality of NF cartridges. RO cartridges and/or NF cartridges may be spirally wound semipermeable membrane cartridges, or cartridges made using hollow fiber technology having suitable membrane characteristics. For example, E. I. DuPont sells RO cartridges of hollow fine fiber (HFF) type, which are marketed by DuPont as their HFF B-9 cartridges and which may be used. A spirally wound semipermeable membrane cartridge may include a plurality of leaves which are individual envelopes of sheet-like semipermeable membrane material that sandwich therebetween a layer of porous permeate carrying material, such as polyester fibrous sheet material. The semipermeable membrane material may be any of those commercially available materials. Interleaved between adjacent leaves may be lengths of spacer material, which may be woven or other open mesh, screen-like crosswise designs of synthetic filaments, e.g. cross-extruded filaments of polypropylene or the like such as those sold under the trade names VEXAR and NALLE, that provide flow passageways for the feed water being pumped from end to end through a pressure vessel. A lay-up of such alternating leaves and spacer sheets may then be spirally wound about a hollow tube having a porous sidewall to create a right circular cylindrical cartridge.

One spirally wound separation cartridge is disclosed in U.S. Pat. No. 4,842,736, the disclosure of which is incorporated herein by reference, which provides a plurality of spiral feed passageways which extend axially from end to end of the ultimate cartridge, through which passageways the feed liquid being treated flows in an axial direction. Internally within the membrane envelopes, the permeating liquid flows along a spiral path inward in a carrier material until it reaches the porous central tube where it collects and through which it then flows axially to the outlet.

In some embodiments, RO cartridges and/or NF cartridges may be selected so as to accomplish the desired overall function of producing a stream of processed water having the desired ionic concentrations from seawater or the like. RO elements or cartridges may be selected from suitable semipermeable membranes of the polyamide composite membrane variety, wherein a thin film of polyamide may be interfacially formed on a porous polysulfone support or the like that may be in turn formed on a highly porous fibrous backing material. RO membranes may be designed to reject more than about 95% of dissolved salts, for example about 98% or more.

Suitable commercially available RO membranes include those sold as AG8040F and AG8040-400 by Osmonics; SW30 Series and LE by Dow-FilmTec; as DESAL-11 by Desalination Systems, Inc.; as ESPA by Hydranautics; as ULP by Fluid Systems, Inc.; and as ACM by TriSep Corporation.

NF membranes may be employed which are designed to selectively reject divalent or larger ions, and the NF elements or cartridges which are used may reject a minimum of about 80%, for example more than about 90%, or about 95%, or about 98% of the divalent or larger ions in an aqueous feed. The NF membrane may also at least moderately reduce the monovalent ion content, for example less than about 70%, or less than about 50%, or less than about 30%, or less than about 20% of the monovalent ion content. Suitable commercially available NF membranes can be purchased either in sheet form or in finished spirally wound cartridges, and include those sold as SEASOFT 8040DK, 8040DL, and SESAL DS-5 by Osmonics; as NF200 Series and NF-55, NF-70 and as NF-90 by Dow-Film Tec; as DS-5 and DS-51 by Desalination Systems, Inc., as ESNA-400 by Hydranautics; and as TFCS by Fluid Systems, Inc.

In some embodiments, a mechanical method, such as passing the unprocessed water 402 through a nano-filtration membrane, may be used to remove ions from the water at the surface before injecting it into the wellbore and/or adding an agent. Sea water may contain from about 2700 to about 2800 ppm of divalent $SO_4^-$. The nano-filtration membrane process 433 may reduce this concentration to about 20 to about 150 ppm. A 99% reduction in sulfate content may be achievable.

In some embodiments, chemicals and/or additives may be injected into the untreated water 402 to inhibit the in-situ growth of crystals from insoluble salt precipitation. A variety of additives may be injected into the injection water at the surface or directly into an injection well. Production wells may also often be treated with back-flow of fresh brine containing additives to prevent plugging of the passageways.

In some embodiments, salt water may be processed 433, 434, and/or 436 by multistage flash distillation, multieffect distillation, reverse osmosis and/or vapor compression distillation. Membrane technologies have been used in the pretreatment of salt water to reduce the high ionic content of salt water relative to fresh water. Ion selective membranes may be used which selectively prevent certain ions from passing across it while at the same time allowing the water and other ions to pass across it. The selectivity of a membrane may be a function of the particular properties of the membrane, including the pore size or electrical charge of the membrane. Accordingly, any of the known and commercially available ion selective membranes which meet these criteria can be used. For example, a polyamide membrane is particularly effective for selectively preventing sulfate, calcium, magnesium and bicarbonate ions from passing across it, and could be used for processes 433 and/or 434. A polyamide membrane having the trade name SR90-400 (Film Tec Corporation) or Hydranautics CTC-1 may be used.

In some embodiments of the invention, unprocessed water 402 containing a high concentration of hardness ions (for example divalent cations) is passed through an ion selective membrane 434 to form a softened salt water having a reduced concentration of hardness ions. The softened salt water is fed to a desalination system 436. Then, some of the hardness ions may be added back to the water at 438.

Microfiltration (MF), ultrafiltration (UF), nanofiltration (NF), and reverse osmosis (RO) are all pressure-driven separation processes allowing a broad range of neutral or ionic molecules to be removed from fluids. Microfiltration may be used for removal of suspended particles greater than about 0.1 microns. Ultrafiltration may be used to exclude dissolved molecules greater than about 5,000 molecular weight. Nanofiltration membranes may be used for passing at least some salts but having high rejection of organic compounds having molecular weights greater than approximately 200 Daltons. Reverse osmosis membranes may be used for high rejection of almost all species. While NF and RO are both capable of excluding salts, they typically differ in selectivity. NF membranes commonly pass monovalent ions while maintaining high rejection of divalent ions. By contrast, reverse osmosis membranes are relatively impermeable to almost all ions, including monovalent ions such as sodium and chloride ions. NF membranes have sometimes been described as "loose" RO membranes. One suitable membrane capable of removing dissolved salts from water is the cellulose acetate membrane, with selectivity resulting from a thin discriminating layer that is supported on a thicker, more porous layer of the same material. Another suitable membrane is made of piperazine or substituted piperazine. Other suitable membranes include polymers such as the commercial FilmTec NF40 NF membranes.

In some embodiments, a spiral-wound filter cartridge may be used to incorporate large amounts of RO or NF membrane into a small volume. Such an element can be made by wrapping feed spacer sheets, membrane sheets, and permeate spacer sheets around a perforated permeate tube.

In some embodiments, interfacial polymerization may be used to make thin film composite membranes for RO and NF separations. This process is commonly performed as a polycondensation between amines and either acid chlorides or isocyanates.

Reverse osmosis membranes may have high rejection of virtually all ions, including sodium and chloride. NF membranes are often characterized as those having a substantial passage of neutral molecules having molecular weights less than 200 daltons and monovalent ions. NF membranes still commonly possess high rejection of divalent ions due to charge interactions. Membranes having a continuum of properties between RO and NF can also be produced. In addition to high rejection of at least one species, commercial membranes often possess high water permeability.

In some embodiments, membranes for RO and/or NF may be piperazine-based membranes, where at least 60% of amine-containing monomers incorporated into the polymer may be piperazine or piperazine derivative molecules. One typical example of a piperazine-based membrane is the FilmTec NF40 NF membrane, which has been made by contacting piperazine and TMC in the presence of an acid acceptor, N,N-dimethylpiperazine. The FilmTec commercial membranes NF45 and SR90 have been made by similar processes, with additional proprietary chemicals added to the water and/or organic phase. A particularly useful property of some membranes is the ability to selectively remove some molecules while retaining others. For example, the dairy industry has used piperazine-based membranes to concentrate large neutral molecules (whey and lactose) while removing minerals. In other cases it is desired to pass monovalent salts while maintaining high rejection of divalent ions.

In some embodiments, processes 334, 433, and/or 434 may use one or a series of NF devices, such as a membrane. In some embodiments, processes 334 and/or 436 may use one or more RO devices, such as a membrane.

In some embodiments of the invention, processed water 303 and/or 403 may be combined with one or more of the aromatics, for example, benzene, toluene, or xylene; turpentine; tetralin; chlorinated hydrocarbons, for example, carbon tetrachloride or methlyene chloride; or other hydrocarbons, for example $C_5$-$C_{10}$ hydrocarbons and/or alcohols; steam; or sulfur compounds, for example, hydrogen sulfide, and then injected into a formation for enhanced oil recovery. For example, a mixture of processed water with an agent for increasing the viscosity mixed with alcohol, may be injected into a formation.

The reduction of the monovalent and/or divalent cation level of an injection water may achieve one or more of the following benefits:

When oil is attached to the clay surface by the bridging of calcium to the clay and the oil drop, the addition of low salinity water may cause the calcium to diffuse into the bulk solution and liberate the oil droplet;

When oil is attached to the clay surface by the bridging of calcium to the clay and the oil drop, the addition of low salinity water may cause another ion to replace the calcium bonded to the clay, and liberate the oil droplet attached to the calcium by multivalent ion exchange;

The addition of low salinity water may cause a oil wet reservoir to convert into a water wet reservoir and release the oil; providing increased oil recovery for a reservoir, particularly for a high salinity reservoir.

The addition of multivalent cations to an injection water may achieve one or more of the following benefits: reduced clay swelling, increased oil recovery for a reservoir, particularly for a high salinity reservoir.

Water may be commonly injected into subterranean hydrocarbon-bearing formations by itself or as a component of miscible or immiscible displacement fluids to recover hydrocarbons therefrom. Unprocessed water 302 and/or 402 can be obtained from a number of sources including brine produced from the same formation, brine produced from remote formations, or sea water. All of these waters may have a high ionic content relative to fresh water. Some ions present in unprocessed water 302 and/or 402 can benefit hydrocarbon production, for example, certain combinations and concentrations of cations and anions, including $K^+$, $Na^+$, $Cl^-$, $Br^-$, and/or $OH^-$, can stabilize clay to varying degrees in a formation susceptible to clay damage from swelling or particle migration. Other ions (or the same ions that benefit hydrocarbon production) present in the unprocessed water 302 and/or 402 can produce harmful effects in situ, for example, divalent $SO_4^-$ anions in the injection water may be particularly problematic because $SO4^-$ may form salts with cations already present in the formation, such as $Ba^{++}$. The resulting salts can be relatively insoluble at the formation temperatures and pressures. Consequently they may precipitate out of solution in situ. Solubility of the salts may further decreases as the injection water is produced to the surface with the hydrocarbons because of pressure and temperature decreases in the production well. The precipitates of the insoluble salts may accumulate in subterranean fluid passageways as crystalline structures, which ultimately plug the passageways and reduce hydrocarbon production. The effects of plugging may be most severe in passageways located in the formation near wellbores and in production wells where it may be more difficult for the produced fluids to circumvent blocked passageways. Removal of divalent $SO4^-$ anions from injection water could also reduce the nutrient available for the growth of sulfate reducing bacteria in subsurface environments to effectively mitigate reservoir souring.

In some embodiments of the invention, processed water or a processed water mixture 303 and/or 403 may be injected into formation 206, produced from the formation 206, and then recovered from the oil and gas, for example, by a centrifuge or gravity separator, and then processing the water at water production 230, then the processed water or a processed water mixture 303 and/or 403 may be re-injected into the formation 206.

In some embodiments of the invention, processed water or a processed water mixture 303 and/or 403 may be injected into an oil-bearing formation 206, optionally preceded by and/or followed by a flush, such as with seawater, a surfactant solution, a hydrocarbon fluid, a brine solution, or fresh water.

In some embodiments of the invention, processed water or a processed water mixture 303 and/or 403 may be used to improve oil recovery. The processed water or a processed water mixture 303 and/or 403 may be utilized to drive or push the now oil bearing flood out of the reservoir, thereby "sweeping" crude oil out of the reservoir. Oil may be recovered at production well 212 spaced apart from injection well 232 as processed water or a processed water mixture 303 and/or 403 pushes the oil out of the pores in formation 206 and to the production well 212. Once the oil/drive fluid reaches the surface, it may be put into holding tanks 218, allowing the oil to separate from the water through the natural forces of gravity.

The amount of oil recovered may be measured as a function of the original oil in place (OOIP). The amount of oil recovered may be greater than about 5% by weight of the original oil in place, for example 10% or greater by weight of the original oil in place, or 15% or greater by weight of the original oil in place.

The process and system may be useful for the displacement recovery of petroleum from oil-bearing formations. Such recovery encompasses methods in which the oil may be removed from an oil-bearing formation through the action of a displacement fluid or a gas.

Other uses for the processed water or a processed water mixture 303 and/or 403 prepared by the process and system of the invention include near wellbore injection treatments, and injection along interiors of pipelines to promote pipelining of high viscosity crude oil. The processed water or a processed water mixture 303 and/or 403 can also be used as hydraulic fracture fluid additives, fluid diversion chemicals, and loss circulation additives.

EXAMPLES

A seawater feed having the following chemical composition was subjected to a first nanofiltration (NF) array, a second NF array, and a reverse osmosis (RO) dual array system. The various permeate and reject streams from the chemical compositions of the NF and RO arrays are also set forth below. All concentrations are expressed in parts per million (ppm).

| Seawater | NF Reject | Array 1 | Array 2 | Combined NF Permeate | |
|---|---|---|---|---|---|
| feed | Mg | 2672.8 | 5111.2 | Mg | 41.8 |
| 1290 Mg | Ca | 863.4 | 1642.1 | Ca | 20.3 |
| 412 Ca | Na | 14205.3 | 17402.9 | Na | 8621.8 |
| 10800 Na | K | 511.8 | 627.1 | K | 310.7 |
| 399 K | SO4 | 5636.6 | 10887 | SO4 | 6.7 |
| 2715 SO4 | HCO3 | 299.6 | 561 | HCO3 | 12.5 |
| 142 HCO3 | Cl | 27349.4 | 36825.2 | Cl | 13734.9 |
| 19420 Cl | tds | 51538.9 | 73056.5 | tds | 22748.7 |
| 35178 tds | | | | | |

| RO Reject | | RO Permeate | |
|---|---|---|---|
| Mg | 122.1 | Mg | 0.6 |
| Ca | 58.1 | Ca | 0.3 |
| Na | 25079.6 | Na | 130 |
| K | 900 | K | 4.6 |
| SO4 | 19.6 | SO4 | 0.1 |
| HCO3 | 36.2 | HCO3 | 0.2 |
| Cl | 39912 | Cl | 206 |
| tds | 66128.6 | tds | 342 |

Figure 5:
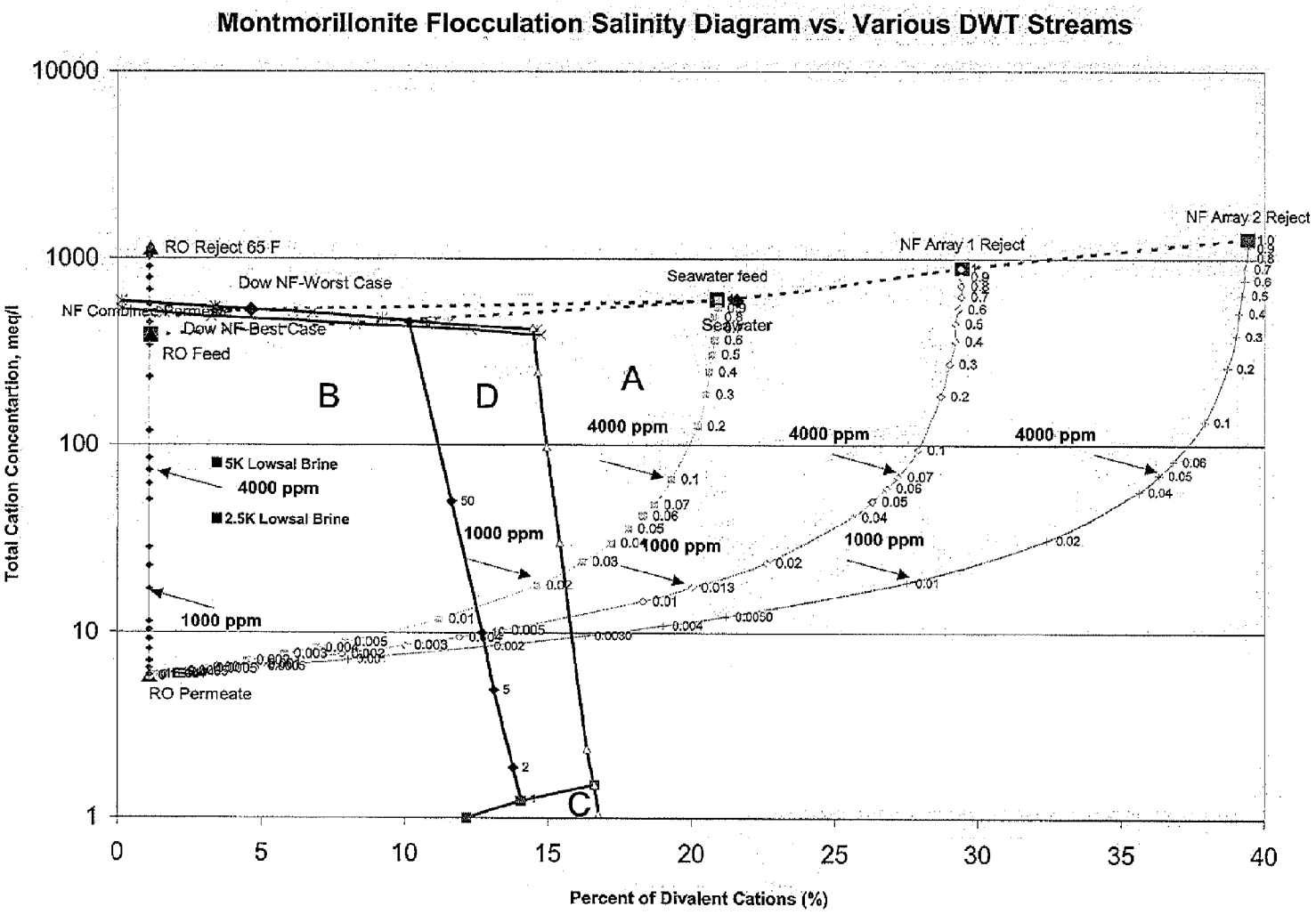

FIG. 5:

Referring now to FIG. 5, an injection water salinity diagram for Smectite (montmorillonite) clays is shown. In region B, there is severe impairment of the clay. For example if the RO permeate with the concentrations above was injected, clay swelling would occur. Region A has no impairment, Region C has a small but acceptable level of impairment, and Region D is the transition area from Region B to Region A, with lessening levels of impairment moving from B to A.

Starting with RO permeate in Region B, to move to Region A, a small amount of NF reject 2, NF reject 1, and/or sea water could be added to the RO permeate. For example, 0.3% (by volume) of NF array 2 reject, 1% of NF array 1 reject, 3% of seawater feed, or 80% of RO reject added to the RO permeate would place the mixture in Region A where no impairment would occur.

In other embodiments, mixtures of two or more of NF array 2 reject, NF array 1 reject, seawater feed, and RO reject could be added to the RO permeate to achieve the same effects.

Figure 6:
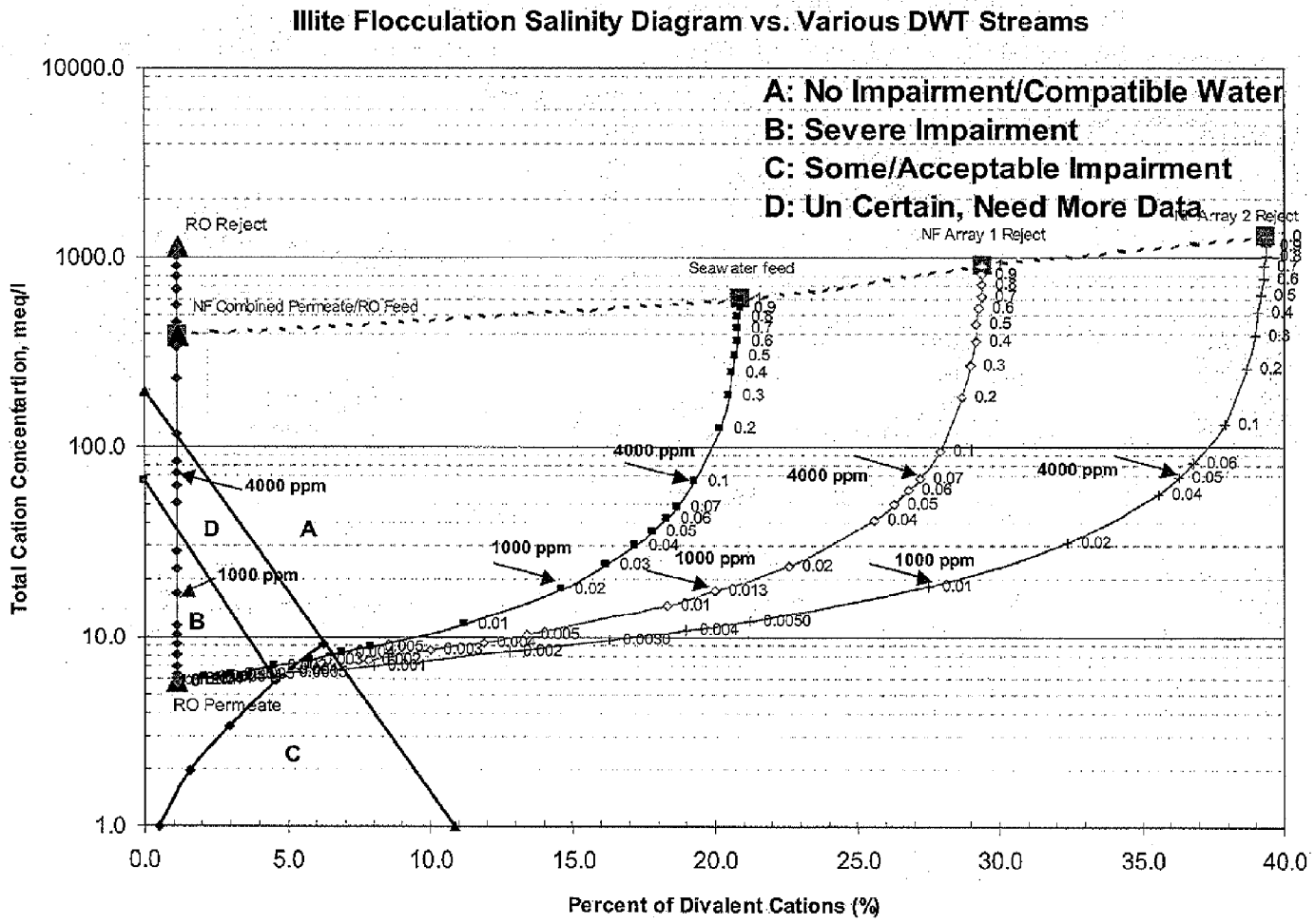

FIG. 6:

Referring now to FIG. 6, an injection water salinity diagram for Illite clays is shown. In region B, there is severe impairment of the clay. For example if the RO permeate with the concentrations above was injected, clay swelling would occur. Region A has no impairment, Region C has a small but acceptable level of impairment, and Region D is the transition area from Region B to Region A, with lessening levels of impairment moving from B to A.

Starting with RO permeate in Region B, to move to Region A, a small amount of NF reject 2, NF reject 1, sea water, RO reject, and/or NF combined permeate could be added to the RO permeate. For example, 0.1% (by volume) of NF array 2 reject, 0.2% of NF array 1 reject, 0.4% of seawater feed, 40% of NF combined permeate, or 20% of RO reject added to the RO permeate would place the mixture in Region A where no impairment would occur.

In other embodiments, mixtures of two or more of NF array 2 reject, NF array 1 reject, seawater feed, NF combined permeate, and RO reject could be added to the RO permeate to achieve the same effects.

Illustrative Embodiments

In one embodiment, there is disclosed a system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some monovalent ions, and then injects the water into the well.

In one embodiment, there is disclosed a system comprising a first well drilled into an underground formation comprising hydrocarbons; a production facility at a topside of a first well; a water production facility connected to the production facility; a second well drilled into the underground formation; wherein the water production facility produces water by removing some multivalent ions, then removing some monovalent ions, and then adding back some monovalent ions, and injects the water into the second well and into the underground formation.

In some embodiments, the first well is a distance of 50 meters to 2000 meters from the second well. In some embodiments, the underground formation is beneath a body of water. In some embodiments, the production facility is floating on a body of water, such as a production platform. In some embodiments, the system also includes a water supply and a water pumping apparatus, adapted to pump water to the water production facility. In some embodiments, the water production facility has an input water having a total dissolved salts value of at least 15,000 parts per million, expressed as sodium chloride dissolved. In some embodiments, the system also includes adding back some multivalent ions. In some embodiments, adding back some monovalent ions comprises mixing the water with some seawater and/or produced water. In some embodiments, removing some multivalent ions comprises subjecting the water to at least one nanofilter. In some embodiments, removing some monovalent ions comprises subjecting the water to at least one reverse osmosis membrane. In some embodiments, adding back some monovalent ions comprises mixing the water with some nanofilter permeate water. In some embodiments, adding back some monovalent ions comprises mixing the water with some reverse osmosis reject water.

In one embodiment, there is disclosed a method comprising removing some multivalent ions from water; removing some monovalent ions from water; adding some monovalent ions to the water; and injecting the water into an underground formation. In some embodiments, the processed water is recycled by being produced with oil and/or gas and separated, and then re-injected into the formation. In some embodiments, one or more of aromatics, chlorinated hydrocarbons, other hydrocarbons, water, carbon dioxide, carbon monoxide, or mixtures thereof are mixed with the processed water prior to being injected into the formation. In some embodiments, the processed water is heated prior to being injected into the formation. In some embodiments, removing some multivalent ions from water comprises removing some divalent cations. In some embodiments, another material is injected into the formation after the processed water was injected. In some embodiments, the another material is selected from the group consisting of air, produced water, salt water, sea water, fresh water, steam, carbon dioxide, and/or mixtures thereof. In some embodiments, the processed water is injected from 10 to 100 bars above the reservoir pressure. In some embodiments, the oil in the underground formation prior to water being injected has a viscosity from 0.1 cp to 10,000 cp. In some embodiments, the underground formation has a permeability from 5 to 0.0001 Darcy. In some embodiments, input water has a total dissolved salts value of at least 15,000 parts per million, expressed as sodium chloride dissolved, prior to the removing any ions from the water. In some embodiments, adding some monovalent ions to the water comprises mixing the water with at least one of seawater and produced water. In some embodiments, removing some multivalent ions from the water comprises subjecting the water to at least one nanofilter. In some embodiments, removing some monovalent ions from the water comprises subjecting the water to at least one reverse osmosis membrane. In some embodiments, adding some monovalent ions to the water comprises mixing the water with a nanofilter permeate stream. In some embodiments, adding some monovalent ions to the water comprises mixing the water with a reverse osmosis reject stream.

In one embodiment, there is disclosed a method of preparing a high salinity water for injection in an enhanced oil recovery process, comprising removing some sulfates from the water; removing some divalent ions from the water; removing some monovalent ions from the water; adding some monovalent ions to the water; and then injecting the water into an underground oil containing formation. In some embodiments, the method also includes adding back in some of the removed divalent ions prior to injecting the water. In some embodiments, the method also includes adding some divalent ions to the water prior to injecting the water.

In one embodiment, there is disclosed a method of preparing a high salinity water for injection in an enhanced oil recovery process, comprising removing some ions from the water with a nano-filtration process; removing some additional ions from the water with a reverse osmosis process; adding some monovalent ions to the water; and then injecting the water into an underground oil containing formation. In some embodiments, the method also includes adding back in some of the removed ions prior to injecting the water by adding a portion of a nano-filtration permeate stream and/or a portion of a reverse osmosis reject stream to the water.

Those of skill in the art will appreciate that many modifications and variations are possible in terms of the disclosed embodiments, configurations, materials and methods without departing from their spirit and scope. Accordingly, the scope of the claims appended hereafter and their functional equivalents should not be limited by particular embodiments described and illustrated herein, as these are merely exemplary in nature.

What is claimed is:

1. A method comprising:

removing some multivalent ions from water, wherein removing some multivalent ions from water comprises removing some divalent cations;

removing some monovalent ions from water;

adding some monovalent ions to the water; and injecting the water into an underground formation.

2. The method of claim 1, wherein the processed water is recycled by being produced with oil and/or gas and separated, and then re-injected into the formation.

3. The method of claim 1, wherein one or more of aromatics, chlorinated hydrocarbons, other hydrocarbons, water, carbon dioxide, carbon monoxide, or mixtures thereof are mixed with the processed water prior to being injected into the formation.

4. The methods of claim 1, wherein the processed water is heated prior to being injected into the formation.

5. The method of claim 1, wherein another material is injected into the formation after the processed water was injected.

6. The method of claim 5, wherein the another material is selected from the group consisting of air, produced water, salt water, sea water, fresh water, steam, carbon dioxide, and/or mixtures thereof.

7. The method of claim 1, wherein the processed water is injected from 10 to 100 bars above the reservoir pressure.

8. The method of claim 1, wherein the oil in the underground formation prior to water being injected has a viscosity from 0.1 cp to 10,000 cp.

9. The method of claim 1, wherein the underground formation has a permeability from 5 to 0.0001 Darcy.

10. The method of claim 1, wherein input water has a total dissolved salts value of at least 15,000 parts per million, expressed as sodium chloride dissolved, prior to the removing any ions from the water.

11. The method of claim 1, wherein adding some monovalent ions to the water comprises mixing the water with at least one of seawater and produced water.

12. The method of claim 1, wherein removing some multivalent ions from the water comprises subjecting the water to at least one nanofilter.

13. The method of claim 12, wherein adding some monovalent ions to the water comprises mixing the water with a nanofilter permeate stream.

14. The method of claim 1, wherein removing some monovalent ions from the water comprises subjecting the water to at least one reverse osmosis membrane.

15. The method of claim 14, wherein adding some monovalent ions to the water comprises mixing the water with a reverse osmosis reject stream.

16. A method of preparing a high salinity water for injection in an enhanced oil recovery process, comprising:

removing some sulfates from the water;

selectively removing some divalent ions from the water;

selectively removing some monovalent ions from the water;

adding some monovalent ions to the water; and then injecting the water into an underground oil containing formation.

17. The method of claim 16, further comprising adding back in some of the removed divalent ions prior to injecting the water.

18. The method of claim 16, further comprising adding some divalent ions to the water prior to injecting the water.

19. A method of preparing a high salinity water for injection in an enhanced oil recovery process, comprising:

removing some ions from the water with a nano-filtration process, wherein removing some ions from the water with a nano-filtration process comprises removing some divalent cations from the water;

removing some additional ions from the water with a reverse osmosis process;

adding some monovalent ions to the water; and then injecting the water into an underground oil containing formation.

20. The method of claim 19, further comprising adding back in some of the removed ions prior to injecting the water by adding a portion of a nano-filtration permeate stream and/or a portion of a reverse osmosis reject stream to the water.

* * * * *